US012599950B2

(12) United States Patent
Zhu et al.

(10) Patent No.: US 12,599,950 B2
(45) Date of Patent: Apr. 14, 2026

(54) METHOD FOR PREVENTION OF PREMATURE EDGE FRACTURE AT DRAW BEAD

(71) Applicant: Cleveland-Cliffs Steel Properties Inc., West Chester, OH (US)

(72) Inventors: Feng Zhu, Ontario (CA); Sobhan Nazari Tiji, Ypsilanti, MI (US); Panagiotis Makrygiannis, Windsor (CA); Jimmy J. Zhang, Troy, MI (US); Yu-Wei Wang, Farmington Hills, MI (US)

(73) Assignee: Cleveland-Cliffs Steel Properties Inc., West Chester, OH (US)

( * ) Notice: Subject to any disclaimer, the term of this patent is extended or adjusted under 35 U.S.C. 154(b) by 274 days.

(21) Appl. No.: 18/210,265

(22) Filed: Jun. 15, 2023

(65) Prior Publication Data

US 2024/0001424 A1 Jan. 4, 2024

Related U.S. Application Data

(60) Provisional application No. 63/357,276, filed on Jun. 30, 2022.

(51) Int. Cl.
*B21D 22/26* (2006.01)

(52) U.S. Cl.
CPC ..... *B21D 22/26* (2013.01)

(58) Field of Classification Search
CPC ..... B21D 22/20; B21D 22/22; B21D 22/26; B21D 24/04; B21D 24/12; B21D 25/04; B21D 26/059; B21D 35/007; B21D 22/203
See application file for complete search history.

(56) References Cited

U.S. PATENT DOCUMENTS

| | | | |
|---|---|---|---|
| 6,745,609 | B2 | 6/2004 | Garnett et al. |
| 7,234,336 | B2 | 6/2007 | Braun et al. |
| 7,748,743 | B2 | 7/2010 | Knaup |
| 7,971,466 | B2 | 7/2011 | Yoshitome et al. |
| 8,056,384 | B2 | 11/2011 | Schwenk |
| 8,191,588 | B2 | 6/2012 | Hagano |
| 8,505,352 | B2 | 8/2013 | Flehmig et al. |

(Continued)

FOREIGN PATENT DOCUMENTS

| | | | |
|---|---|---|---|
| EP | 3680036 | A1 | 7/2020 |
| EP | 3804875 | A1 | 4/2021 |
| EP | 3929793 | A1 | 12/2021 |

OTHER PUBLICATIONS

International Search Report and Written Opinion dated Sep. 29, 2023 for Application No. PCT/US2023/024949, 10 pages.

*Primary Examiner* — Teresa M Ekiert
(74) *Attorney, Agent, or Firm* — FBT Gibbons LLP

(57) ABSTRACT

A system for forming a steel material includes a first binder, a second binder, a punch and a carrier blank. The first binder and the second binder are configured to form a draw bead shape in the steel material by compressing the steel material between a draw bead protrusion and a draw bead channel. The punch is configured to form the steel material relative to the first binder and the second binder. The carrier blank is positioned on a surface of the steel material and is configured to cover a portion of the draw bead shape during formation of the draw bead shape in the steel material.

19 Claims, 15 Drawing Sheets

(56) References Cited

U.S. PATENT DOCUMENTS

| | | | |
|---|---|---|---|
| 8,522,593 | B2 | 9/2013 | Flehmig et al. |
| 8,613,819 | B2 | 12/2013 | Vehof |
| 8,756,970 | B2 | 6/2014 | Golovashchenko |
| 8,919,169 | B2 | 12/2014 | Smith |
| 9,003,858 | B1 | 4/2015 | Lin et al. |
| 9,120,137 | B2 | 9/2015 | Zhou et al. |
| 9,149,854 | B2 | 10/2015 | Zhou et al. |
| 9,211,579 | B2 | 12/2015 | Tanaka et al. |
| 9,266,160 | B2 | 2/2016 | Nakamura et al. |
| 9,266,162 | B2 | 2/2016 | Tanaka et al. |
| 9,327,332 | B2 | 5/2016 | Flehmig et al. |
| 9,415,433 | B2 | 8/2016 | Moore |
| 9,511,403 | B2 | 12/2016 | Yonemura et al. |
| 9,669,447 | B2 | 6/2017 | Flehmig et al. |
| 9,770,749 | B2 | 9/2017 | Wu et al. |
| 9,827,606 | B2 | 11/2017 | Zhou et al. |
| 9,839,951 | B2 | 12/2017 | Nishimura et al. |
| 9,844,809 | B2 | 12/2017 | Xia et al. |
| 9,849,496 | B2 | 12/2017 | Ota et al. |
| 9,914,163 | B2 | 3/2018 | Shiozaki et al. |
| 9,919,351 | B2 | 3/2018 | Walde et al. |
| 9,962,752 | B2 | 5/2018 | Uchiyama et al. |
| 9,968,977 | B2 | 5/2018 | Marks et al. |
| 9,975,162 | B2 | 5/2018 | Ludlow et al. |
| 10,022,763 | B2 | 7/2018 | Tanaka et al. |
| 10,022,766 | B2 | 7/2018 | Fujii et al. |
| 10,023,246 | B2 | 7/2018 | Ito et al. |
| 10,029,293 | B2 | 7/2018 | Fujii et al. |
| 10,124,387 | B2 | 11/2018 | Nakazawa et al. |
| 10,196,090 | B2 | 2/2019 | Karpenman |
| 10,226,809 | B2 | 3/2019 | Henksmeier et al. |
| 10,265,752 | B2 | 4/2019 | Otsuka et al. |
| 10,286,436 | B2 | 5/2019 | Sumikawa et al. |
| 10,406,582 | B2 | 9/2019 | Nishimura et al. |
| 10,486,215 | B2 | 11/2019 | Sohmshetty et al. |
| 10,500,624 | B2 | 12/2019 | Ageba et al. |
| 10,500,625 | B2 | 12/2019 | Fujii et al. |
| 10,577,027 | B2 | 3/2020 | Ito |
| 10,596,611 | B2 | 3/2020 | Nishimura et al. |
| 10,639,695 | B2 | 5/2020 | Shinmiya et al. |
| 10,792,721 | B1 | 10/2020 | Danby et al. |
| 10,828,685 | B2 | 11/2020 | Miyagi et al. |
| 10,858,048 | B2 | 12/2020 | Saito |
| 10,875,068 | B2 | 12/2020 | Kavik et al. |
| 10,898,938 | B2 | 1/2021 | Otsuka et al. |
| 10,933,457 | B2 | 3/2021 | Ito |
| 10,946,427 | B2 | 3/2021 | Miyagi et al. |
| 10,946,432 | B2 | 3/2021 | Turner et al. |
| 11,000,890 | B2 | 5/2021 | Otsuka et al. |
| 11,020,785 | B2 | 6/2021 | Saito et al. |
| 11,135,633 | B2 | 10/2021 | Tanaka et al. |
| 11,155,305 | B2 | 10/2021 | Ito et al. |
| 2008/0264138 | A1 | 10/2008 | Woo |
| 2012/0279271 | A1* | 11/2012 | Carter ..... B21D 39/031 72/342.94 |
| 2013/0213108 | A1 | 8/2013 | Knerr |
| 2014/0047891 | A1 | 2/2014 | Flehmig et al. |
| 2018/0043413 | A1 | 2/2018 | Ueno et al. |
| 2021/0316352 | A1* | 10/2021 | Shinmiya ..... B21D 22/22 |
| 2021/0406424 | A1* | 12/2021 | König ..... B21D 22/20 |

* cited by examiner

METHOD FOR PREVENTION OF PREMATURE EDGE FRACTURE AT DRAW BEAD

PRIORITY

This application claims priority to U.S. Provisional Application Ser. No. 63/357,276, entitled "Method for Prevention of Premature Edge Fracture at Draw Bead," filed on Jun. 30, 2022, the disclosure of which is incorporated by reference herein.

BACKGROUND

The present invention pertains to forming processes used to form steel sheets, steel plates, and other materials. Forming is performed to mechanically deform a material into a predetermined shape. In one version, a sample blank of steel sheet or various alternative materials may be inserted into a die set. This die set may include a draw bead to control material flow during forming. First, the sample blank is formed on its periphery to the shape of the draw bead by an upper binder and a lower binder. Then, a punch is pressed into the sample blank to form the sample blank into a part of predetermined shape.

In some circumstances, cracking of the sample blank may occur before it is formed into the predetermined shape. Such undesirable cracks may initially appear at the edges of the sample blank and then propagate from the edges. For instance, one possible location of such cracking at edges may occur at or near the draw bead. Such premature cracking may be undesirable because it may limit the amount of deformation permitted by the die set, thereby rendering the process less robust. Thus, the sample blank may not be able to reach a final predetermined shape in contexts where premature cracking occurs at or near the draw bead. Therefore, it is desirable to avoid premature edge cracking during forming processes.

DETAILED DESCRIPTION

A variety of materials may be subjected to forming processes using a variety of forming die set configurations. Although examples are described herein in the context of forming methods for steel sheet, it should be understood that various alternative materials may readily be used with similar forming methods. Suitable alternative materials may include steel plate, coated or uncoated steel sheets or plates, aluminum sheets or plates, nickel copper alloys, copper nickel alloys, titanium alloys, steel sheets or plates combined with other non-steel sheets or plates, and/or etc. Additionally, various forming die set configurations may be used while still incorporating the principles described herein. Although the term "forming" is used herein with reference to described configurations and processes, it should be understood that other deformation processes such as stamping may be used in connection with the principles described herein.

Figure 1A:
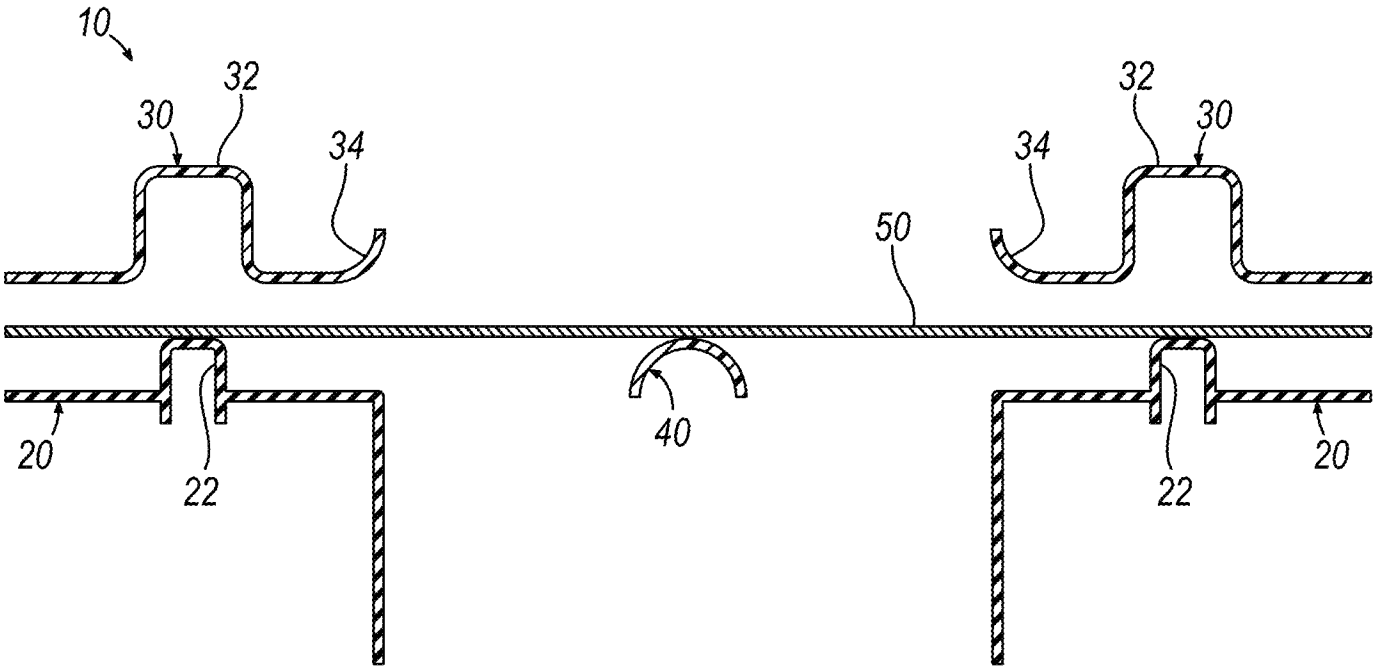
FIG. 1A depicts a front cross-sectional view of a version of a forming die set in an initial configuration.

FIG. 1A shows a version of a forming die set (10) (also referred to as a forming apparatus) for use with various forming methods described in greater detail below. Forming die set (10) includes a lower binder (20), an upper binder (30), and a punch (40). Although not shown, it should be understood that one or more of lower binder (20), upper binder (30), and/or punch (40) may be in communication with certain motion generating features and/or drive features in some versions to facilitate relative motion between lower binder (20), upper binder (30), and punch (40). By way of example only, such motion generating features may include hydraulic rams/cylinders, lead screws, linear actuators, and/or etc.

Lower binder (20) and upper binder (30) are configured to move toward each other to hold a sample blank (50) between lower binder (20) and upper binder (30) to hold and manipulate sample blank (50), as will be described in greater detail below. Lower binder (20) includes a draw bead protrusion (22) extending upwardly from a surface of lower binder (20) toward upper binder (30). Similarly, upper binder (30) includes a draw bead channel (32) opposite of, and corresponding to, draw bead protrusion (22). Both draw bead protrusion (22) and channel (32) are complementary to each other such that draw bead protrusion (22) may be received within draw bead channel (32) during forming. Thus, it should be understood that draw bead channel (32) is generally larger in depth and width relative to draw bead protrusion (22) to accommodate the thickness of sample blank (50) and/or other components, as will be described in greater detail below.

Both draw bead protrusion (22) and draw bead channel (32) may define a variety of complementary configurations. For instance, in the present version, draw bead protrusion (22) is formed as a square or rectangular protrusion with rounded corners. Similarly, draw bead channel (32) defines a corresponding square or rectangular protrusion. In other versions, various alternative shapes may be used. In addition, or in the alternative, draw bead protrusion (22) and draw bead channel (32) may extend (e.g., into and out of the page) for a given length corresponding to the length of sample blank (50). In still other examples, multiple separate draw bead protrusion (22) and draw bead channel (32) combinations may be used.

Regardless of the particular configuration of draw bead protrusion (22) and draw bead channel (32) used, both draw bead protrusion (22) and draw bead channel (32) are generally configured to engage sample blank (50) to hold sample blank (50) in position. In particular, and as will be described in greater detail below, draw bead protrusion (22) and draw bead channel (32) are configured to move towards each other to compress sample blank (50) therebetween. Draw bead protrusion (22) may then nest within draw bead channel (32), thereby deforming at least a portion of sample blank (50) to form a draw bead within sample blank (50).

In the present version, lower binder (20) and upper binder (30) are in a symmetrical configuration with a pair of respective draw bead protrusions (22) and draw bead channels (32). In this configuration, punch (40) is disposed between the pair of draw bead protrusions (22) and draw bead channels (32) such that sample blank (50) may be formed by punch (40) between draw bead protrusions (22) and draw bead channels (32). Although a symmetrical configuration is used in the present configuration, it should be understood that in other versions, various alternative configurations (both symmetrical and non-symmetrical) may be used. In addition, or in the alternative, in some versions various alternative numbers of draw bead protrusion (22) and draw bead channel (32) combinations may be used. Suitable numbers of draw bead protrusion (22) and draw bead channel (32) may include one, three, four, or more. It should be understood that the particular configuration used may vary by a variety of factors such as the desired formed shape of sample blank (50), the gauge or thickness of sample blank (50), the particular material of sample blank (50), and/or etc.

Upper binder (30) of the present example further defines an upper binder radius (34) disposed near draw bead channel (32) and oriented towards punch (40). As will be described in greater detail below, upper binder radius (34) defines a generally partially cylindrical shape, which is generally configured to bend or otherwise deform a portion of sample blank (50) in conjunction with punch (40).

Punch (40) is configured to engage sample blank (50) to deform sample blank (50) relative to lower binder (20) and upper binder (30). Thus, punch (40) is configured to be driven upwardly in the direction of upper binder (30) to deform sample blank (50) into a predetermined shape. In the present version, punch (40) defines a partially cylindrical surface that is configured to engage sample blank (50). In other versions, punch (40) may have a variety of alternative shapes either separately or in combination with the partially cylindrical surface shown. By way of example only, suitable alternative shapes may include square, rectangular, triangular, certain irregular shapes, and/or etc. Such alternative shapes may be used in combination with certain radii to provide multiple surface connections.

Figure 1B:
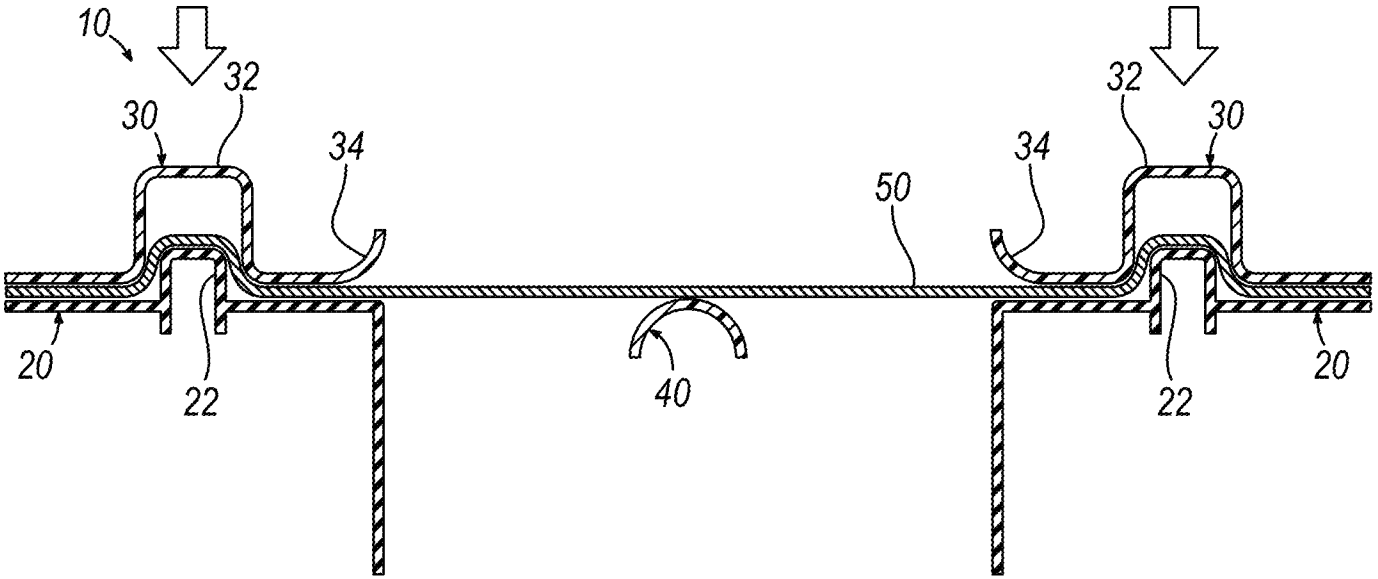
FIG. 1B depicts another front cross-sectional view of the forming die set of FIG. 1A, the forming die set in a closing configuration.
Figure 1C:
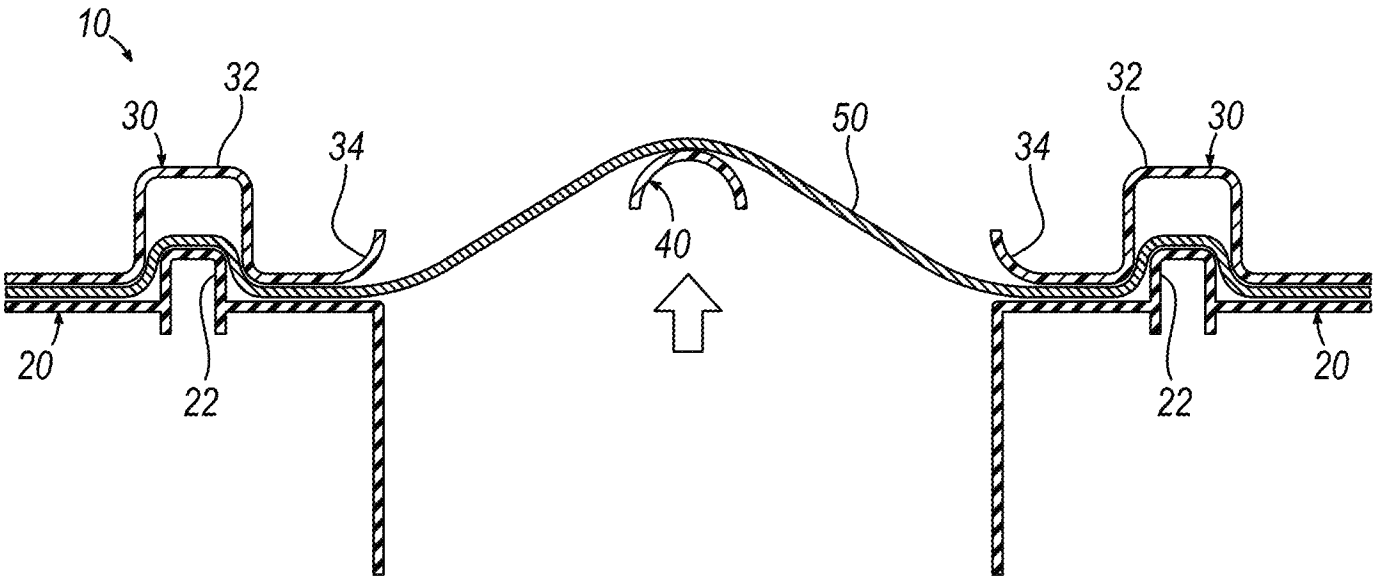
FIG. 1C depicts yet another front cross-sectional view of the forming die set of FIG. 1A, the forming die set in a forming configuration.

FIGS. 1A through 1C show an example forming process with forming die set (10) being used to deform sample blank (50). As seen in FIG. 1A, forming die set (10) may initially be in an initial configuration with lower binder (20) and upper binder (30) separated from each other. In this initial configuration, sample blank (50) may be inserted between lower binder (20) and upper binder (30) as shown in FIG. 1A.

After insertion of sample blank (50) between lower binder (20) and upper binder (30), one or more of lower binder (20) and upper binder (30) may be moved to compress sample blank (50) between lower binder (20) and upper binder (30). As best seen in FIG. 1B, lower binder (20) and upper binder (30) may be moved into a closing configuration. In this configuration, draw bead protrusion (22) of lower binder (20) may be received within draw bead channel (32) of upper binder (30). Meanwhile, sample blank (50) may be deformed between draw bead protrusion (22) and draw bead channel (32) to form a draw bead shape within sample blank (50). As a result, sample blank (50) may be secured between lower binder (20) and upper binder (30) when forming die set (10) is in the closing configuration.

After sample blank (50) is located between lower binder (20) and upper binder (30), sample blank (50) may be formed with relative movement between punch (40) and the combination of lower binder (20) and upper binder (30). As can be seen in FIG. 1C, punch (50) may move upwardly toward upper binder (30) to engage sample blank (50). This movement may bend or deform sample blank (50) relative to lower binder (20) and upper binder (30) to deform sample blank (50) into a predetermined shape defined by the geometry of lower binder (20), upper binder (30), and punch (40). Movement of punch (40) may continue until sample blank (50) is in the final predetermined shape.

In some versions, it may be desirable to incorporate certain features into forming die set (10) to make sample blank (50) more resistant to cracking. For instance, under some circumstances, some cracking may occur in sample blank (50) during the forming process described above. When crack initiation is premature, cracking occurs before the sample blank (50) reaches its full deformation potential. Full deformation potential of a given sample blank (50) may be defined in some circumstances by the fracture limit of the steel forming the given sample blank (50). When cracking occurs prior to reaching the full deformation potential of sample blank (50), sample blank (50) may fail prior to the completion of formation using forming die set (10), thereby preventing formation of a predetermined formation geometry. Therefore, it may be desirable in such circumstances to incorporate certain features into forming die set (10) to make sample blank (50) more resistant to cracking, particularly premature cracking during the formation process. Such resistance to cracking may result in a reduction in the overall defect rate of the formation process and/or permit greater deformation of sample blank (50) during deformation.

Cracking may generally occur at or near the draw bead formed in sample blank (50) by draw bead protrusion (22) and draw bead channel (32). Such cracks are believed to result from stress concentration in sample blank (50) in areas of high deformation. During deformation, the particular way in which the material is deformed and the forces applied may have an impact on how and when crack formation occurs. For instance, the deformation mode, or whether the material is under tension, in shear, or others, may influence the ability of the material to resist cracking. By manipulating the stress and strain distribution, crack formation may be delayed or otherwise avoided. Thus, in some versions, it may be desirable to use features suitable for increasing balanced deformation. In other words, it may be desirable to redistribute deformation to regions of sample blank (50) where some cracking may be acceptable.

Figure 2:
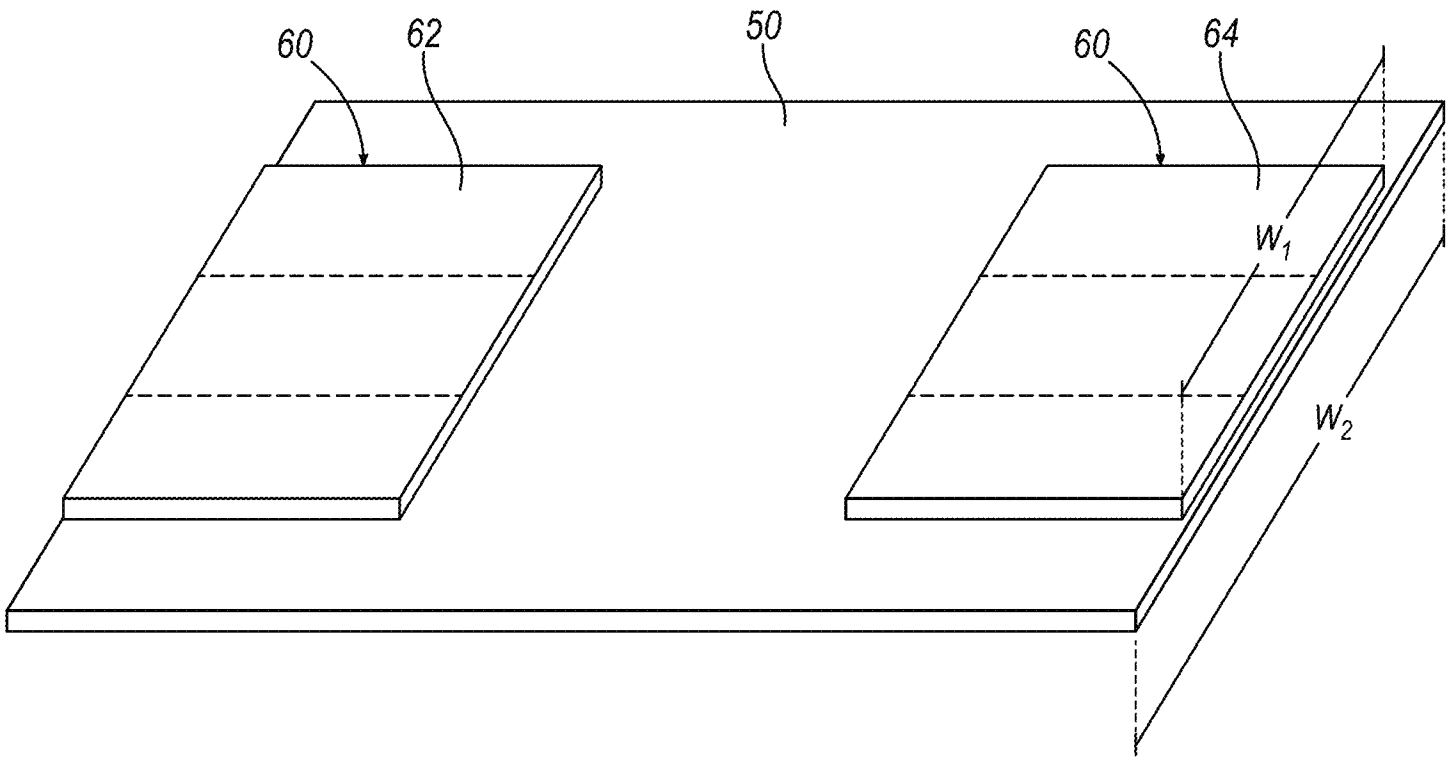
FIG. 2 depicts a perspective view of a version of a sample blank in combination with a version of a carrier blank.

FIG. 2 shows sample blank (50) with a carrier blank (60) disposed on a portion of sample blank (50). Carrier blank (60) of the present version is generally configured to cover a portion or region of sample blank (50) associated with a draw bead. In other words, carrier blank (60) is generally configured to lay on a portion of sample blank (50) so that both carrier blank (60) and sample blank (50) may be received between lower binder (20) and upper binder (30) for formation of a draw bead shape within both carrier blank (60) and sample blank (50). In particular, coverage of carrier blank (60) in the present configuration is isolated to each side of sample blank (50) because draw bead protrusions (22) of forming die set (10) are configured to engage each side of sample blank (50) in the present version. Thus, in versions where the particular configuration of forming die set (10) is varied, the particular coverage of carrier blank (60) may be similarly varied to permit carrier blank (60) to at least overlap with portions of sample blank (50) deformed by lower binder (20) and upper binder (30).

Carrier blank (60) may cover only a portion of sample blank (50) that is ultimately deformed by lower binder (20) and upper binder (30). For instance, as can be seen in FIG. 2, a width ($w_1$) of carrier blank (60) is less than a corresponding width ($w_2$) of sample blank (50). It may be beneficial for width (w1) of carrier blank (60) to be less than width of sample blank (50) because such a width relationship may help to redistribute the stress and strain on sample blank (50) in the region of the draw bead. As a result, less stress and strain may be imposed to the edge of the material of sample blank (50) relative to the region of sample blank (50) further away from the edges. In some versions, width ($w_1$) of carrier blank (60) is one inch less than width ($w_2$) of sample blank (50), thereby providing a half inch gap between each edge of carrier blank (60) and each edge of sample blank (50). In other versions, width ($w_1$) of carrier blank (60) is two inches less than width ($w_2$) of sample blank (50), thereby providing a one inch gap between each edge of carrier blank (60) and each edge of sample blank (50). In still other versions, width ($w_1$) of carrier blank (60) is greater than two inches relative width ($w_2$) of sample blank (50), thereby providing a gap of one inch or more.

Carrier blank (60) of the present version is divided into two parts—a first portion (62) and a second portion (64). First portion (62) and second portion (64) may be disposed on opposite sides of sample blank (50). In this configuration, first portion (62) may correspond to one draw bead protrusion (22) of lower binder (20), while second portion (64) may correspond to another draw bead protrusion (22). As a result, carrier blank (60) may form a gap between first portion (62) and second portion (64) where punch (40) may deform a portion of sample blank (50) without corresponding deformation of carrier blank (60).

Although carrier blank (60) in the present version is of a two-part configuration, it should be understood that various alternative configurations may be used in other versions. For instance, some versions of carrier blank (60) may be a single part. Such single part versions of carrier blank (60) may span the entire length of sample blank (50). In still other versions, carrier blank (60) may be further divided into several different parts. For instance, FIG. 2 shows in phantom how each of first portion (62) and second portion (64) may be separated into three respective parts for a total of six parts. In yet other versions, various suitable numbers of carrier blank (60) divisions may be made as will be apparent to those of ordinary skill in the art in view of the teachings herein.

As will be described in greater detail below, the thickness of carrier blank (60) may be configured to influence the deformation mode of sample blank (50). In the present version, the particular thickness of carrier blank (60) is about equal to the thickness of sample blank (50). In other words, the ratio of carrier blank (60) thickness to sample blank (50) thickness may be about 1:1. In other versions, the particular thickness of carrier blank (60) may be smaller or greater than the thickness of sample blank (50). In still other versions, the particular thickness of carrier blank (60) is any suitable thickness. In other words, a ratio of 1, less than 1, or more than 1. In other version, the particular thickness of carrier blank (60) may be varied based on a variety of factors such as the bead radius, bead height, bead width, bead clearance, sample blank (50) gauge and grade, and/or etc.

Carrier blank (60) includes a metallic material generally configured to bend in cooperation with sample blank (50). It should be understood that carrier blank (60) may include a variety of metallic and non-metallic materials. In some versions, carrier blank (60) includes an alloy substantially similar to the alloy of sample blank (50). For instance, in some versions, sample blank (50) may include a steel of a certain grade. Thus, in such versions, carrier blank (60) may include a steel of the same grade or similar grade. In other versions, carrier blank (60) may include a dissimilar material relative to the material of sample blank (50). For instance, in such versions, sample blank (50) may include a steel material, while carrier blank (60) may include another alloy such as aluminum, copper-nickel, nickel-copper, and/or etc. In still other versions, carrier blank (60) may include other non-metallic materials suitable for manipulating distortion within sample blank (50).

Figure 3A:
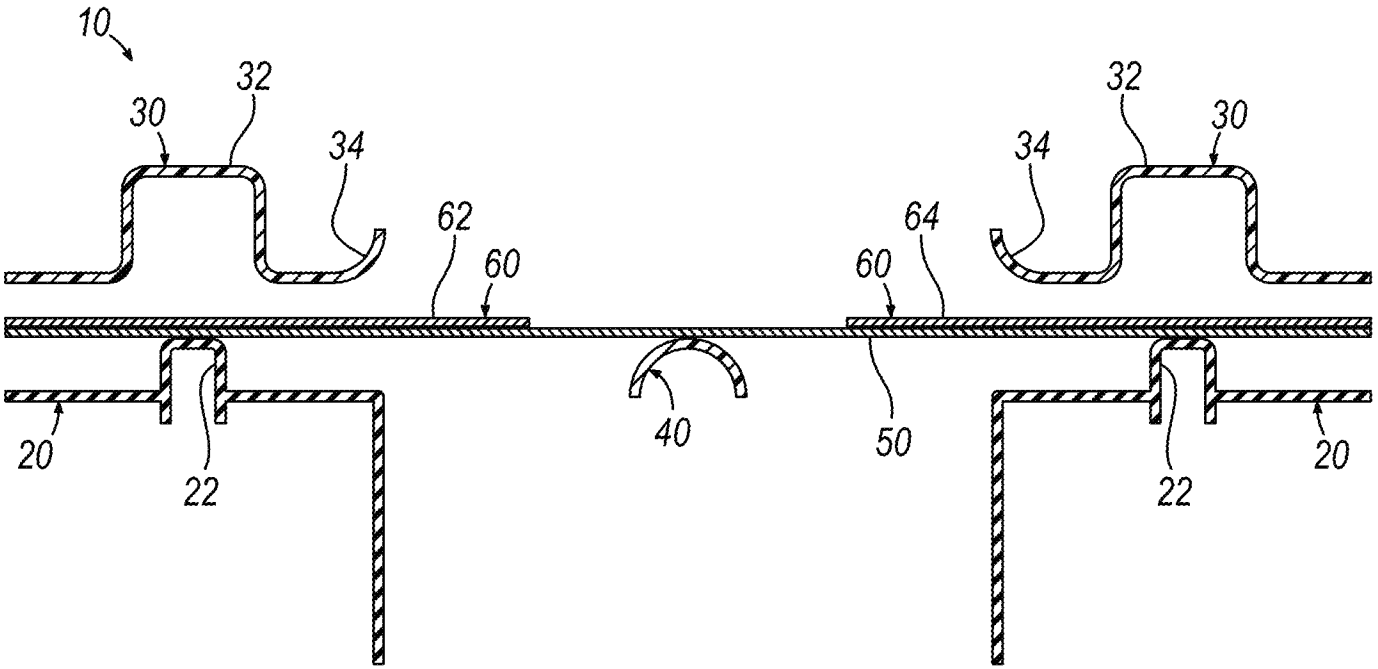
FIG. 3A depicts a front cross-sectional view of the forming die set of FIG. 1A in combination with the sample blank and carrier blank of FIG. 2, the forming die set in the initial configuration.

FIGS. 3A through 4B show an exemplary use of carrier blank (60) with sample blank (50) in combination with forming die set (10). The use described herein may be similar to the use described above with respect to sample blank (50) only, but with the addition of carrier blank (60). For instance, as seen in FIG. 3A, forming die set (10) may initially be in the initial configuration with lower binder (20) and upper binder (30) separated from each other. In this initial configuration, sample blank (50) may be inserted between lower binder (20) and upper binder (30) as shown in FIG. 3A. Carrier blank (60) may also be inserted between lower binder (20) and upper binder (30), either separately or in combination with sample blank (50).

In the present version, carrier blank (60) is positioned on top of sample blank (50). In other words, carrier blank (60) may be positioned between sample blank (50) and upper binder (30) such that upper binder (30) may engage carrier blank (60) directly and lower binder (20) may engage sample blank (50) directly. This particular configuration may be desirable to control the deformation mode associated with sample blank (50) by controlling how upper binder (30) and lower binder (20) exert force on sample blank (50). For instance, in the present version, sample blank (50) may engage draw bead protrusion (22) directly, while carrier blank (60) may engage draw bead channel (32) directly. As will be described in greater detail below, this particular engagement may result in the deformation mode of sample blank (50) being manipulated to rebalance the distribution of strain exerted on portions of sample blank (50).

Figure 3B:
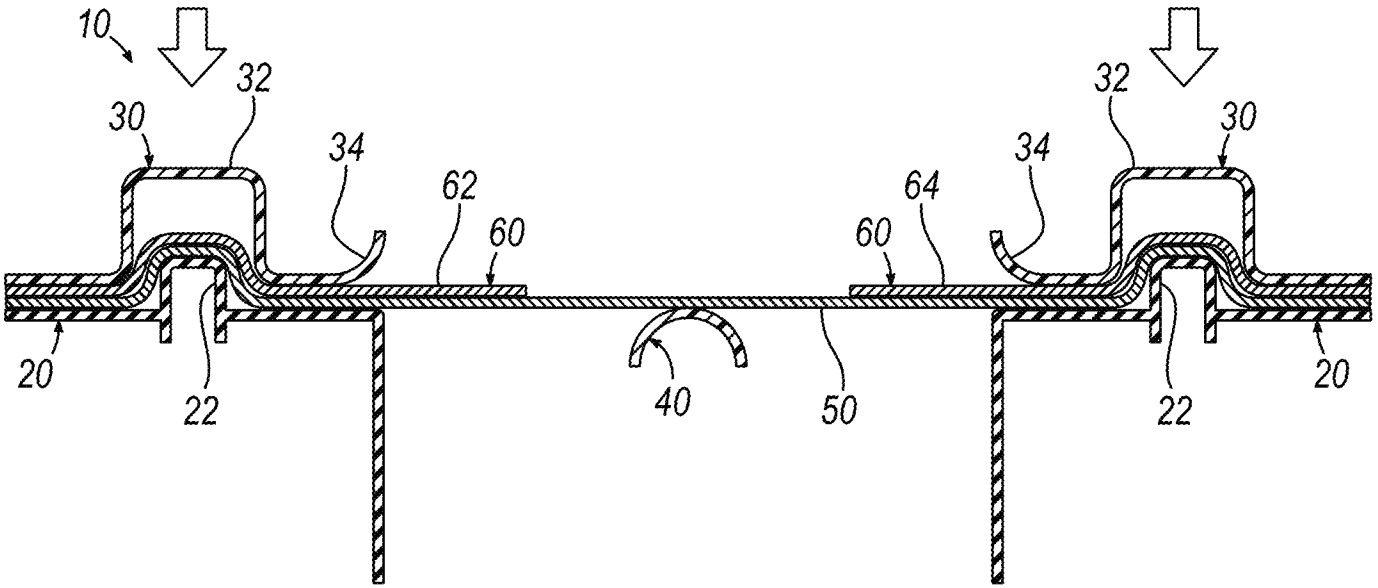
FIG. 3B depicts another front cross-sectional view of the forming die set of FIG. 1A in combination with the sample blank and carrier blank of FIG. 2, the forming die set in the closing configuration.
Figure 4A:
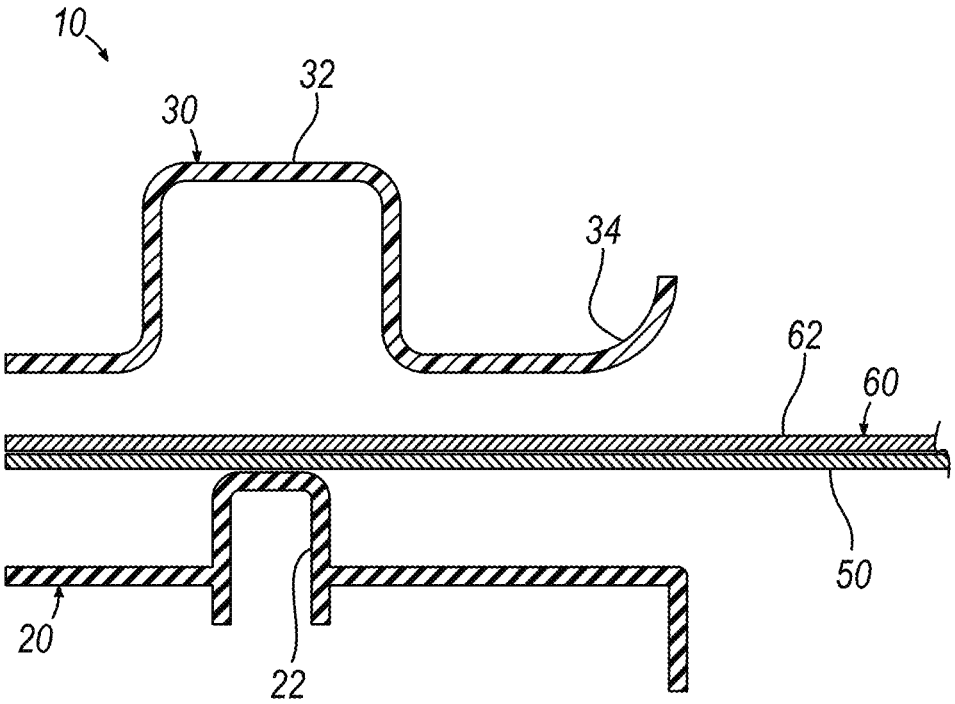
FIG. 4A depicts a detailed front cross-sectional view of the forming die set of FIG. 1A in combination with the sample blank and carrier blank of FIG. 2, the forming die set in the initial configuration.
Figure 4B:
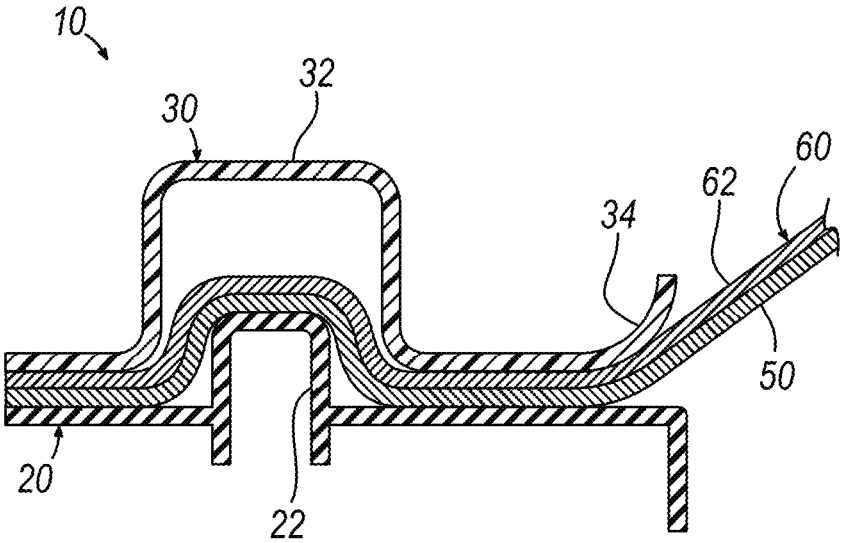
FIG. 4B depicts another detailed front cross-sectional view of the forming die set of FIG. 1A in combination with the sample blank and carrier blank of FIG. 2, the forming die set in the forming configuration.

After insertion of sample blank (50) and carrier blank (60) between lower binder (20) and upper binder (30), one or more of lower binder (20) and upper binder (30) may be moved to compress sample blank (50) between lower binder (20) and upper binder (30). As best seen in FIGS. 3B, 4A, and 4B, lower binder (20) and upper binder (30) may be moved into the closing configuration. In this configuration, draw bead protrusion (22) of lower binder (20) may be received within draw bead channel (32) of upper binder (30). Meanwhile, sample blank (50) and carrier blank (60) may be deformed between draw bead protrusion (22) and draw bead channel (32) to form a draw bead within both sample blank (50) and carrier blank (60). As a result, sample blank (50) and carrier blank (60) may together be secured between lower binder (20) and upper binder (30) when forming die set (10) is in the closing configuration.

Figure 3C:
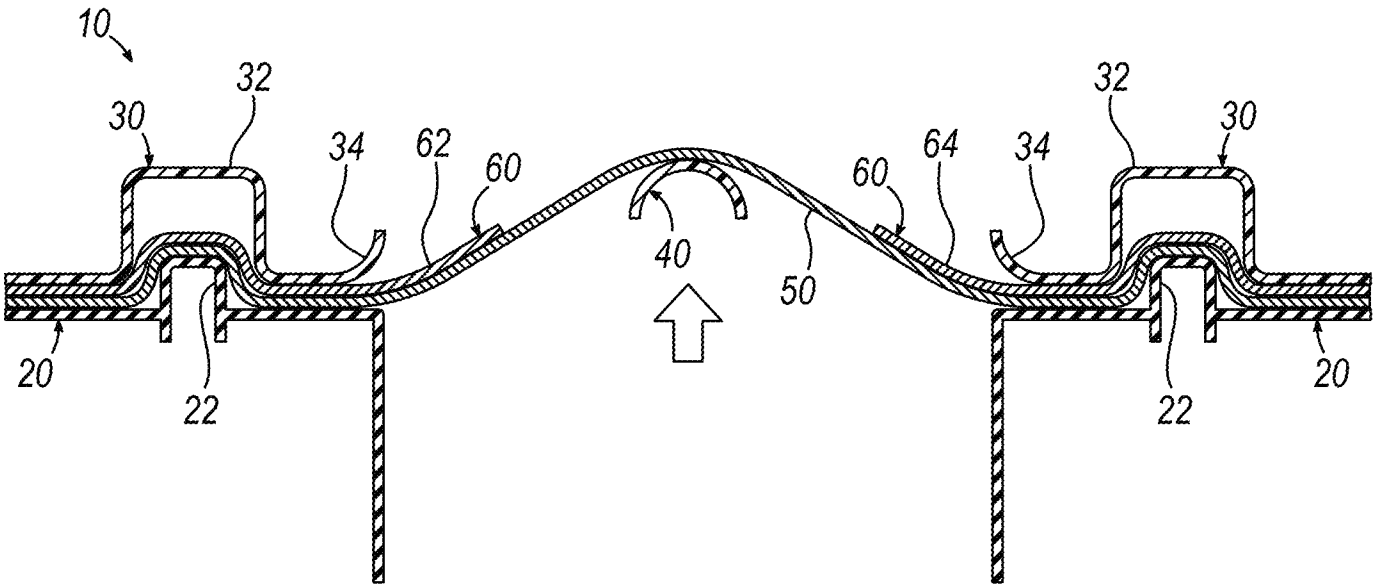
FIG. 3C depicts yet another front cross-sectional view of the forming die set of FIG. 1A in combination with the sample blank and carrier blank of FIG. 2, the forming die set in the forming configuration.

After sample blank (50) and carrier blank (60) are securely closed between lower binder (20) and upper binder (30), sample blank (50) may be formed using relative movement between punch (40) and the combination of lower binder (20) and upper binder (30). As noted above, carrier blank (60) of the present version is in a two-part configuration. Thus, only a portion of carrier blank (60) may be deformed by punch (40). However, it should be understood that in other versions, such as single-part versions, carrier blank (60) may be also fully deformed by punch (40). As can be seen in FIG. 3C, punch (40) may move upwardly toward upper binder (30) to engage sample blank (50). This movement may bend or deform sample blank (50) relative to lower binder (20) and upper binder (30) to deform sample blank (50) into a predetermined shape defined by the geometry of lower binder (20), upper binder (30), and punch (40). Movement of punch (40) may continue until sample blank (50) is in the final predetermined shape.

Example 1

A first test sample was prepared in accordance with the description of sample blank (50) described above. The first test sample was subjected to a stretch bending process in accordance with the processes described above with respect to forming die set (10) and FIGS. 1A through 1C.

Figure 5:
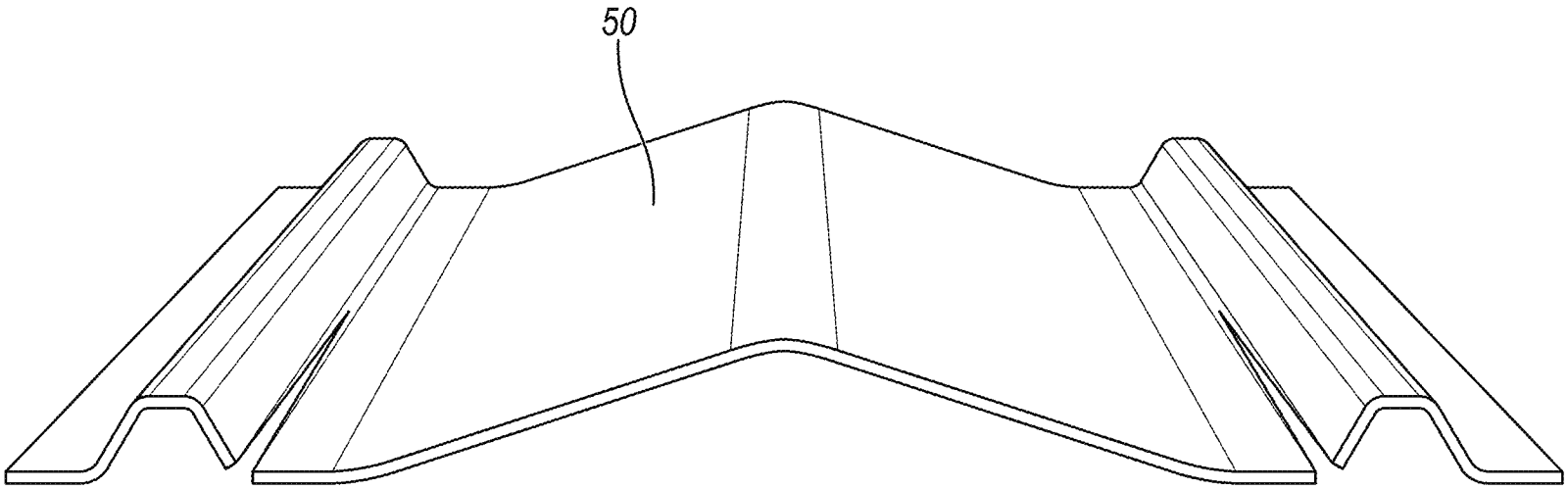
FIG. 5 depicts a perspective view of a sample blank formed without a carrier blank.
Figure 6:
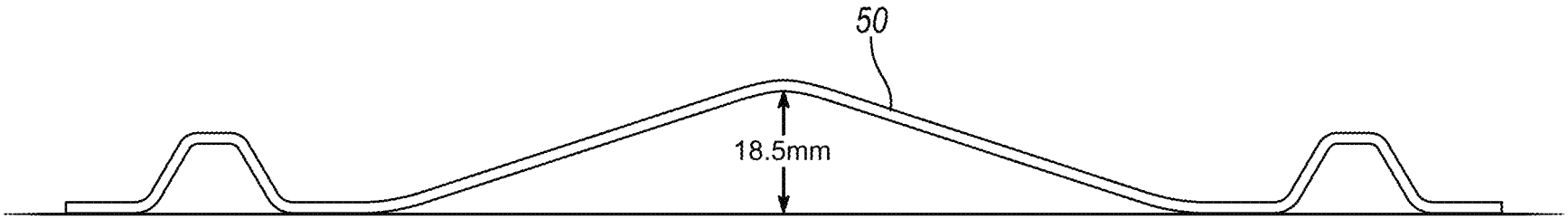
FIG. 6 depicts front elevational view of the sample blank of FIG. 5.

During the step of bending using a structure similar to punch (40), premature edge fracture was observed. As can be seen in FIGS. 5 and 6, the edge fracture appeared at a draw depth of 18.5 mm. This was 7 mm less than a total designed draw depth of 25.5 mm.

Figure 7:
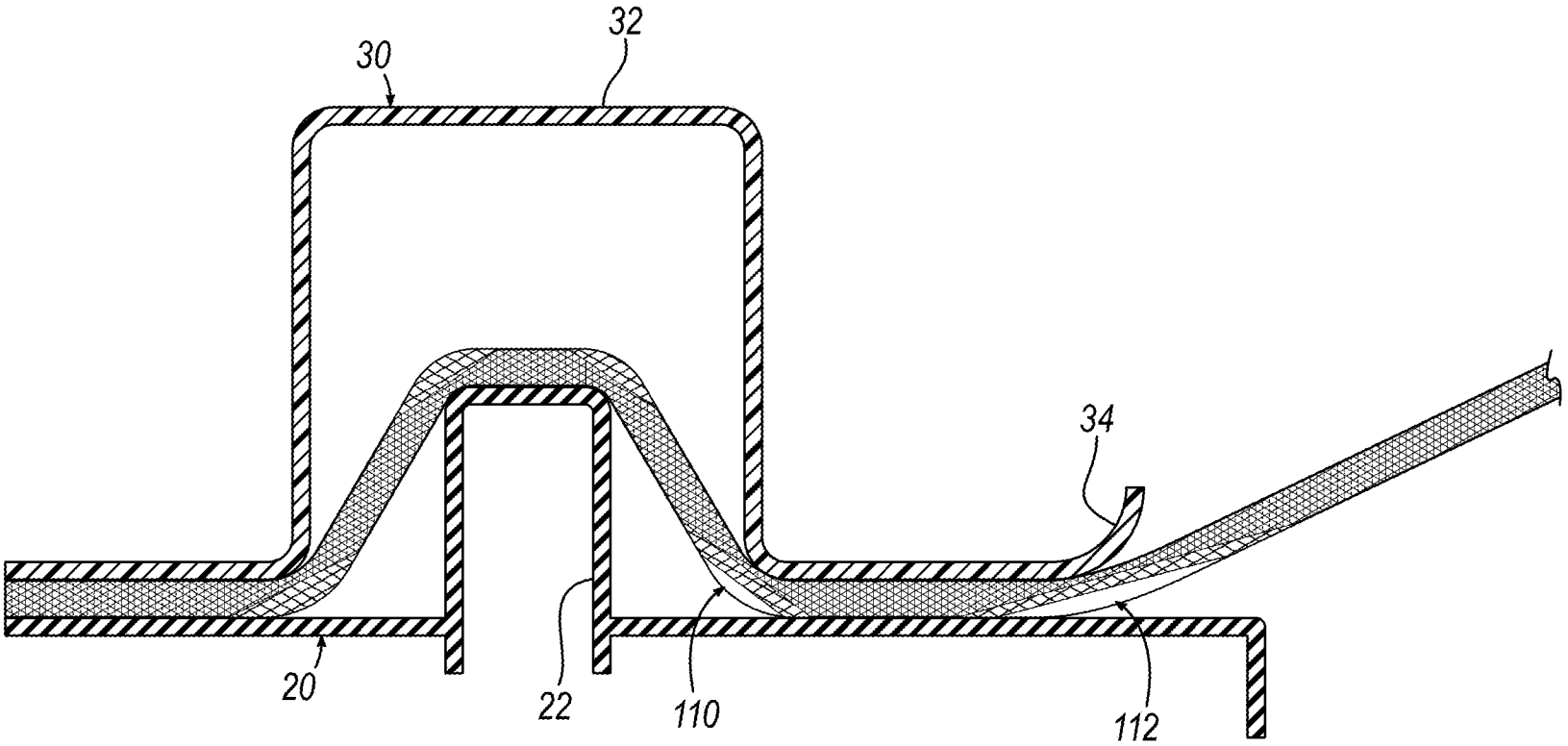
FIG. 7 depicts a front detailed strain heat map of an edge of the sample blank of FIG. 5.

The major strain applied to the first test sample was modeled or simulated using a software application. The particular software used in the present version was AutoForm, although other suitable modeling or simulation software may be used. A heat map resulting from the modeling is shown in FIG. 7. As can be seen, most stretching was observed at the corner of the draw bead channel (110) and at the upper binder radius (112). The modeled major strain at the draw bead channel (110) was 0.171 and the modeled major strain at the upper binder radius (112) was 0.143.

Example 2

A second test sample was prepared in accordance with the description of sample blank (50) described above. The second test sample was also subjected to a stretch bending process using the same equipment as with the first test sample. However, unlike the first test sample, the second test sample was subjected to the stretch bending process in combination with a carrier blank sample prepared in accordance with the description of carrier blank (60) described above. Thus, the stretch bending process was in accordance with the processes described above with respect to forming die set (10) and FIGS. 3A through 4B.

Figure 8:
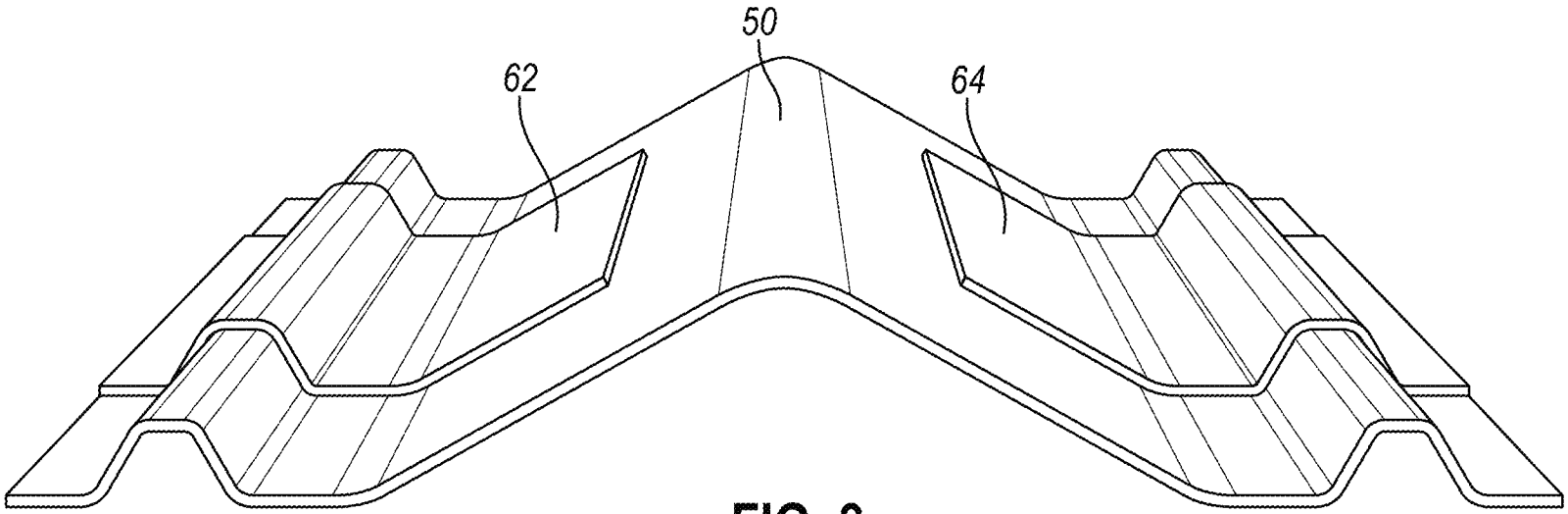
FIG. 8 depicts a perspective view of another sample blank formed with a carrier blank.
Figure 9:
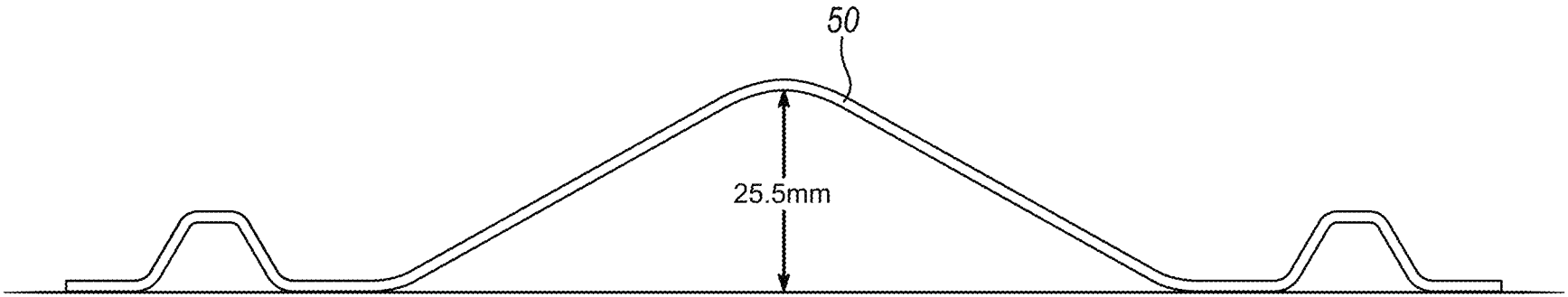
FIG. 9 depicts a front elevational view of the sample blank of FIG. 8.

During the step of bending, the second test sample was deformed to the total designed draw depth of 25.5 mm. As can be seen in FIGS. 8 and 9, no premature edge fracture was observed despite a draw depth of 25.5 mm. In comparison to the first test sample, the second test sample achieved an increased formability of 37.8%.

Figure 10:
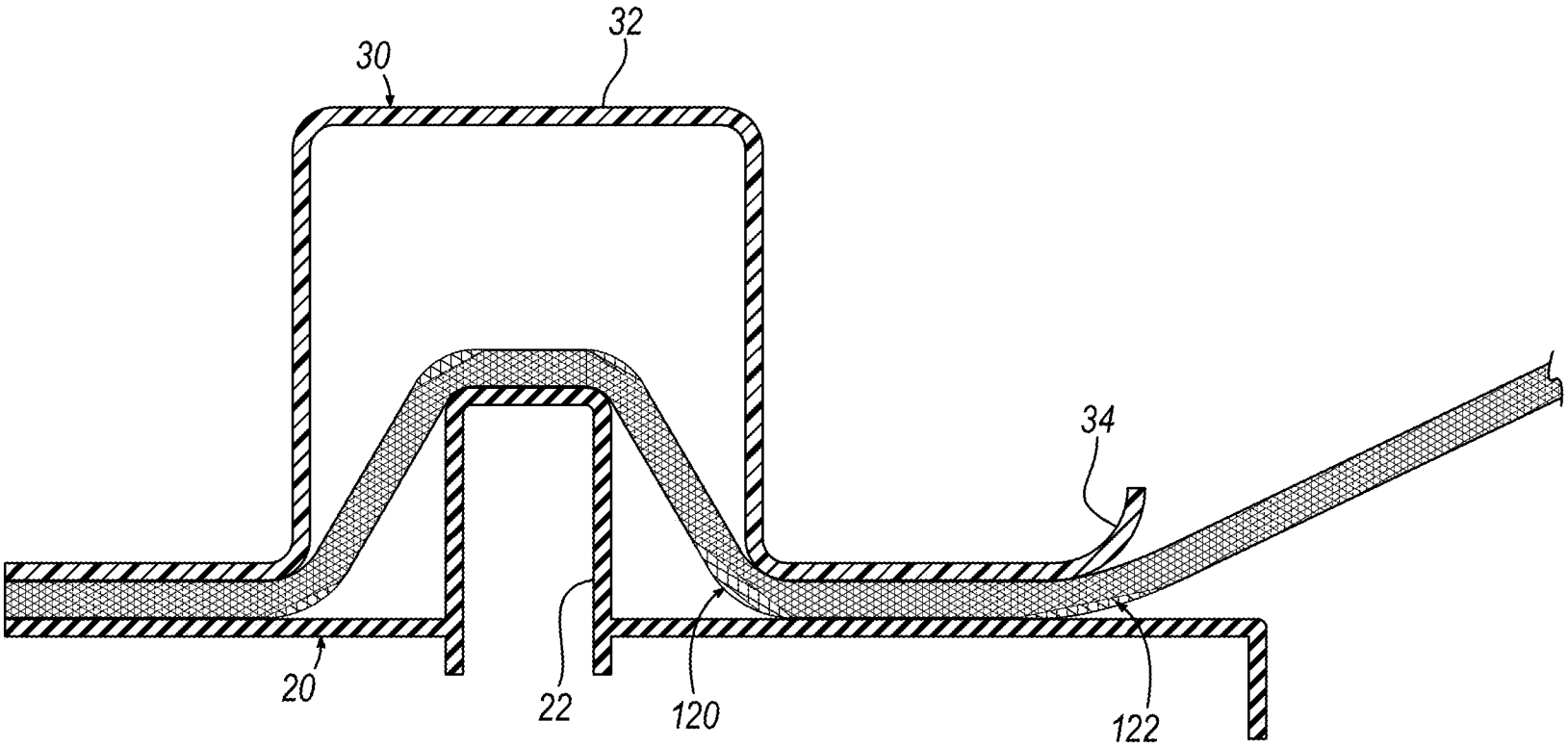
FIG. 10 depicts a front detailed strain heat map of an edge of the sample blank of FIG. 8.

The major strain applied to the second test sample was also modeled or simulated as described above with respect to the first test sample of Example 1. A heat map resulting from the modeling is shown in FIG. 10. As can be seen, most stretching was also observed at the corner of the draw bead channel (120) and at the upper binder radius (122). However, the modeled major strain at the draw bead channel (120) was 0.157 and the modeled major strain at the upper binder radius (122) was 0.09. This represents an 8.2% and 37% reduction in major strain, respectively, in comparison to the modeled major strain of the first test sample of Example 1. In other words, with incorporation of the carrier blank sample, the major strain at the bottom layer of the edge of the second test sample decreased substantially. This reduction in major strain, as well as changes to the deformation mode, is believed to play a substantial role in avoiding premature edge fracture.

Example 3

A third test sample was prepared in accordance with the description of sample blank (50) described above. The third test sample was also subjected to a stretch bending process using the same equipment as with the first test sample. However, unlike the first test sample, the third test sample was subjected to the stretch bending process in combination with a carrier blank sample prepared in accordance with the description of carrier blank (60) described above. Thus, the stretch bending process was generally accordance with the processes described above with respect to forming die set (10) and FIGS. 3A through 4B. However, unlike the second test sample described above with respect to Example 2, the third test sample was formed with the carrier blank sample positioned beneath the third test sample. In other words, the carrier blank sample was positioned adjacent to lower binder (20) rather than upper binder (30) and the third test sample was positioned adjacent to upper binder (30) rather than lower binder (20).

Figure 11:
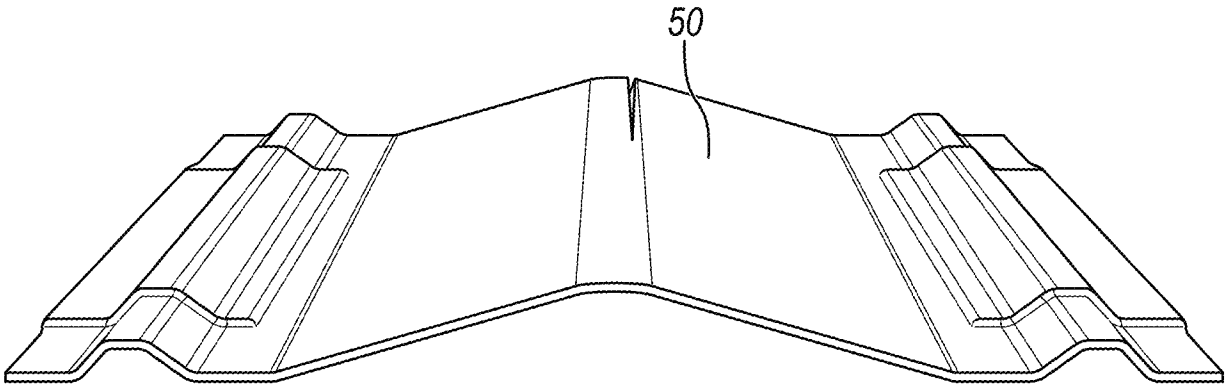
FIG. 11 depicts a perspective view of yet another sample blank formed with a carrier blank.
Figure 12:
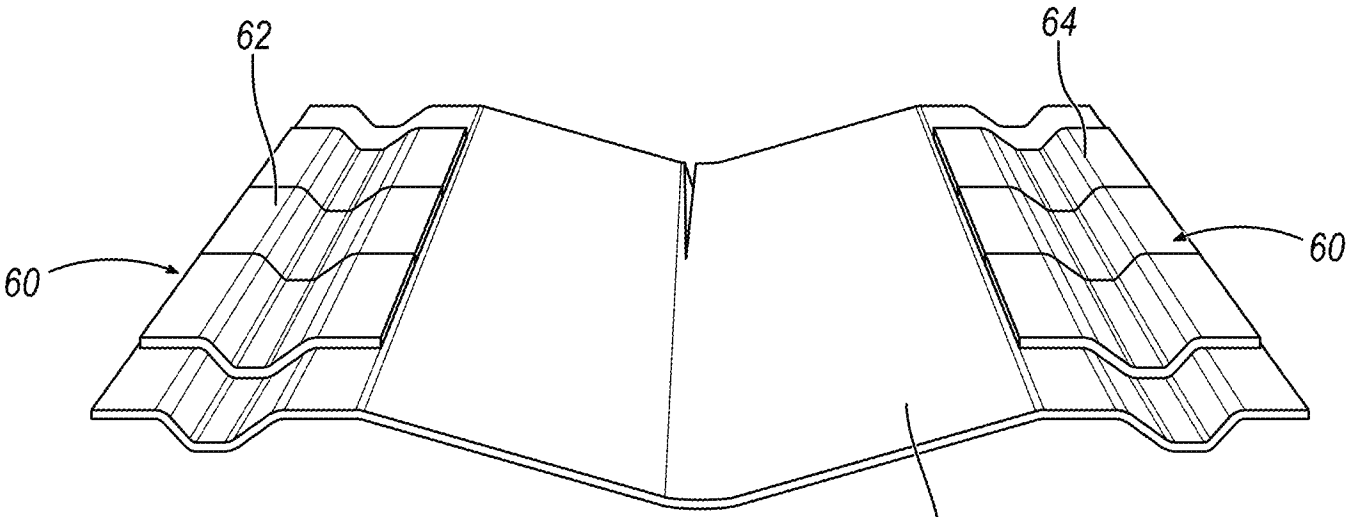
FIG. 12 depicts another perspective view the sample blank of FIG. 11.
Figure 13:
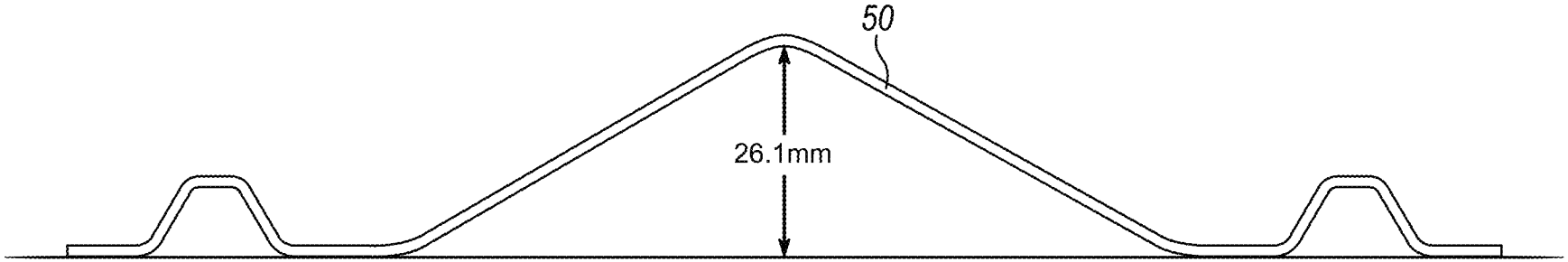
FIG. 13 depicts a front elevational view of the sample blank of FIG. 11.

During the step of bending, the third test sample was deformed to a draw depth of 26.1 mm. As can be seen in FIGS. 11 through 13, no premature edge fracture was observed despite a draw depth of 26.1 mm. In comparison to the first test sample, the third test sample achieved an increased formability of 41%.

Figure 14:
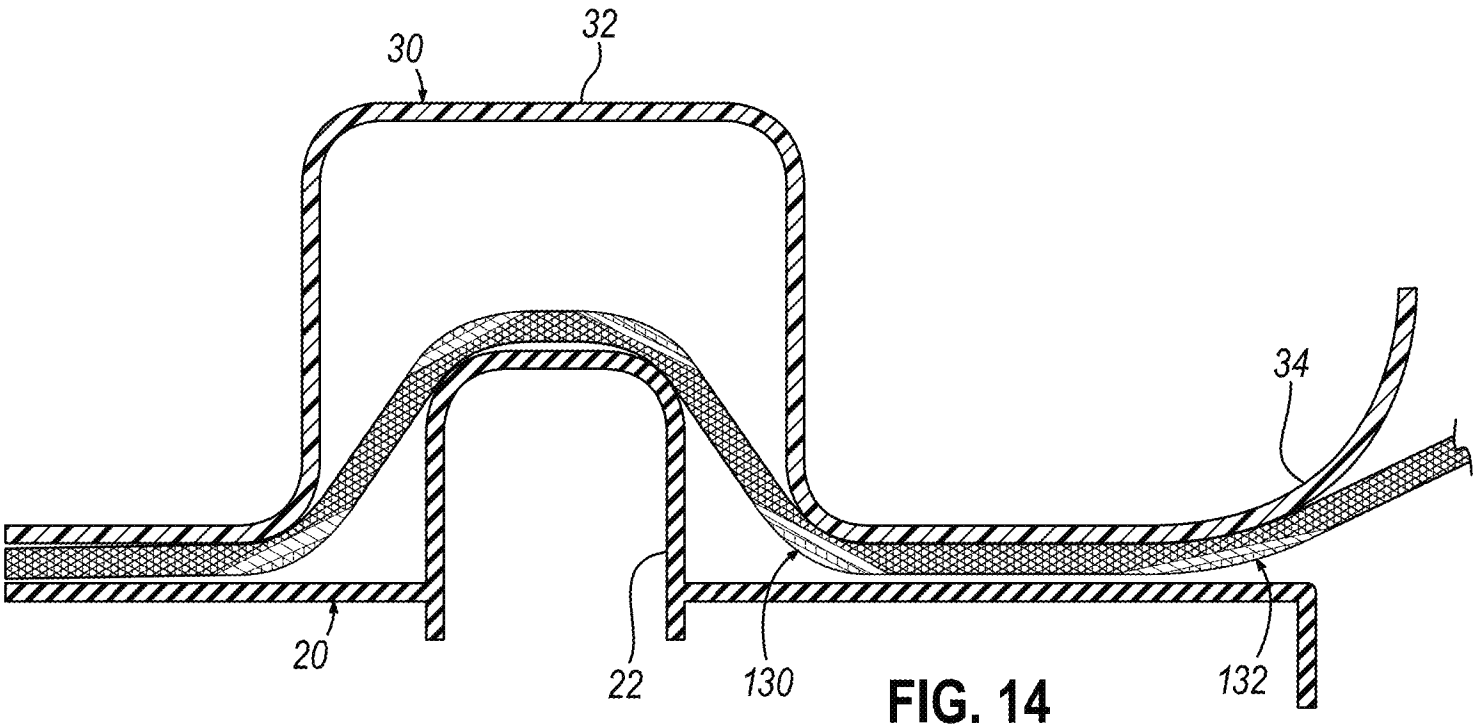
FIG. 14 depicts a front detailed strain heat map of an edge of the sample blank of FIG. 11.

The major strain applied to the third test sample was also modeled or simulated as described above with respect to the first test sample of Example 1 and the second test sample of Example 2. A heat map resulting from the modeling is shown in FIG. 14. As can be seen, most stretching was also observed at the corner of the draw bead channel (130) and at the upper binder radius (132). However, the modeled major strain at the draw bead channel (130) was 0.132 and the modeled major strain at the upper binder radius (132) was generally low. Thus, a general reduction in major strain was observed in comparison to the modeled major strain of the first test sample of Example 1. In other words, with incorporation of the carrier blank sample, the major strain decreased substantially. This decrease in major strain was observed whether the carrier blank sample was positioned on top (Example 2) or on the bottom (Example 3) of the test sample. This reduction in major strain, as well as changes to the deformation mode, is believed to play a substantial role in avoiding premature edge fracture.

In all of Examples 1 through 3, no lubrication, coatings, or other friction reducing mediums were used between test samples, carrier blank samples, and/or bending equipment. In other words, testing was performed with all materials in a bare form.

Example 4

A system for forming a steel material, the system comprising: a first binder; a second binder; the first binder and the second binder being configured to form a draw bead in the steel material by compressing the steel material between a draw bead protrusion and a draw bead channel; a punch, the punch being configured to form the steel material relative to the first binder and the second binder; and a carrier blank positioned on a surface of the steel material, the carrier blank being configured to cover a portion of the draw bead during formation of the draw bead in the steel material.

Example 5

The system of Example 4, the first binder defining the draw bead protrusion, the second binder defining the draw bead channel.

Example 6

The system of any of Examples 4 or 5, the carrier blank being positioned on a surface of the steel material oriented towards the draw bead channel.

Example 7

The system of any of Examples 5 through 6, the carrier blank defining a first thickness, the steel material defining a second thickness, the first thickness being no less than the second thickness.

Example 8

The system of any of Examples 5 through 6, the carrier blank defining a first thickness, the steel material defining a second thickness, the first thickness being about equal to the second thickness.

Example 9

The system of any of Examples 5 through 6, the carrier blank defining a first thickness, the steel material defining a second thickness, the first thickness being greater than the second thickness.

Example 10

The system of any of Examples 4 through 9, the carrier blank defining a first width, the steel material defining a second width, the first width being less than the second width.

Example 11

The system of any of Examples 4 through 9, the carrier blank defining a first width, the steel material defining a second width, the first width being 1 inch less than the second width such that a portion of the steel material is exposed relative to the carrier blank.

Example 12

The system of any of Examples 4 through 9, the carrier blank defining a first width, the steel material defining a second width, the first width being 2 inches less than the second width such that about 1 inch of each side of the steel material is exposed relative to the carrier blank.

Example 13

The system of any of Examples 4 through 12, the carrier blank being in an uncoated condition.

Example 14

A system for forming a steel sheet, the system including: a first binder; a second binder; the first binder and the second binder being configured to form a draw bead shape in the steel sheet by compressing the steel sheet between a draw bead protrusion and a draw bead channel; a punch, the punch being configured to form the steel sheet relative to the first binder and the second binder; and a carrier blank positioned on a face of the steel sheet, the carrier blank being configured to redistribute deformation of the steel sheet from one region of the steel sheet to another during forming of the draw bead shape using the first binder and the second binder.

Example 15

The system of Example 14, the carrier blank being positioned on a face of the steel sheet opposite the draw bead channel during formation of the draw bead shape using the first binder and the second binder.

Example 16

The system of any of Examples 14 or 15, the first binder being positioned below the steel sheet, the carrier blank being positioned above the steel sheet, the second binder being positioned above the carrier blank.

Example 17

The system of any of Examples 14 through 16, the first binder including the draw bead protrusion, the second binder including the draw bead channel.

Example 18

The system of Examples 14 through 17, the carrier blank being substantially free of lubrication.

Example 19

The system of Examples 14 through 18, the carrier blank defining a thickness, the thickness of the carrier blank being equal or greater than a thickness of the steel sheet.

Example 20

A method for forming a steel sheet, the method comprising: placing the steel sheet on a first binder or a second binder; placing a carrier blank on an upwardly oriented surface of the steel sheet; compressing the steel sheet and the carrier blank between the first binder or the second binder to form a draw bead shape in both the sample blank and the carrier blank; and forming a portion of the steel sheet into a predetermined shape by moving a punch relative to the first binder, the second binder or both the first binder and the second binder.

Example 21

The method of Example 20, further comprising moving the first binder towards the second binder to engage the carrier blank with the first binder and the steel sheet with the second binder.

Example 22

The method of any of Examples 20 or 21, the step of compressing the steel sheet and the carrier blank including deforming the sample blank and the carrier blank to form the draw bead shape using a draw bead channel and a draw bead protrusion.

Example 23

The method of any of Examples 20 or 21, the step of compressing the steel sheet and the carrier blank including deforming the sample blank and the carrier blank to form the draw bead shape using a draw bead channel and a draw bead protrusion, the draw bead channel engaging the carrier blank, the draw bead protrusion engaging the steel sheet.

We claim:

1. A system for forming a steel material, the system comprising:

(a) a first binder;

(b) a second binder, the first binder and the second binder being configured to form a draw bead in the steel material by compressing the steel material between a draw bead protrusion and a draw bead channel;

(c) a punch, the punch being configured to form the steel material relative to the first binder and the second binder; and (d) a carrier blank configured to be positioned on a surface of the steel material, the carrier blank being configured to cover a portion of the draw bead during formation of the draw bead in the steel material, at least one dimension of the carrier blank being sized to cover an entire lateral extent of the draw bead protrusion and the draw bead channel.

2. The system of claim 1, the first binder defining the draw bead protrusion, the second binder defining the draw bead channel.

3. The system of claim 1, the carrier blank being configured to be positioned on a surface of the steel material oriented towards the draw bead channel.

4. The system of claim 2, the carrier blank defining a first thickness, the steel material defining a second thickness, the first thickness being no less than the second thickness.

5. The system of claim 2, the carrier blank defining a first thickness, the steel material defining a second thickness, the first thickness being about equal to the second thickness.

6. The system of claim 2, the carrier blank defining a first thickness, the steel material defining a second thickness, the first thickness being greater than the second thickness.

7. The system of claim 1, the carrier blank defining a first width, the steel material defining a second width, the first width being less than the second width.

8. The system of claim 1, the carrier blank defining a first width, the steel material defining a second width, the first width being 1 inch less than the second width such that a portion of the steel material is exposed relative to the carrier blank.

9. The system of claim 1, the carrier blank defining a first width, the steel material defining a second width, the first width being 2 inches less than the second width such that about 1 inch of each side of the steel material is exposed relative to the carrier blank.

10. The system of claim 1, the carrier blank being in an uncoated condition.

11. A system for forming a steel sheet, the system including:

(a) a first binder;

(b) a second binder, the first binder and the second binder being configured to form a draw bead shape in the steel sheet by compressing the steel sheet between a draw bead protrusion and a draw bead channel;

(c) a punch, the punch being configured to form the steel sheet relative to the first binder and the second binder; and (d) a carrier blank configured to be positioned on a face of the steel sheet, the carrier blank being configured to redistribute deformation of the steel sheet from one region of the steel sheet to another during forming of the draw bead shape using the first binder and the second binder by covering an entire lateral extent of the first binder or the second binder.

12. The system of claim 11, the carrier blank being positioned on a face of the steel sheet opposite the draw bead channel during formation of the draw bead shape using the first binder and the second binder.

13. The system of claim 11, the first binder being positioned below the steel sheet, the carrier blank being positioned above the steel sheet, the second binder being positioned above the carrier blank.

14. The system of claim 11, the first binder including the draw bead protrusion, the second binder including the draw bead channel.

15. The system of claim 11, the carrier blank being substantially free of lubrication.

16. The system of claim 11, the carrier blank defining a thickness, the thickness of the carrier blank being equal or greater than a thickness of the steel sheet.

17. A method for forming a steel sheet, the method comprising:

(a) placing the steel sheet on a first binder or a second binder;

(b) placing a carrier blank on an upwardly oriented surface of the steel sheet with the carrier blank overlapping an entire lateral extent of the first binder or the second binder;

(c) compressing the steel sheet and the carrier blank between the first binder and the second binder to form a draw bead geometry in both the steel sheet and the carrier blank; and (d) forming a portion of the steel sheet into a predetermined shape by moving a punch relative to the first binder, the second binder or both the first binder and the second binder, wherein the step of compressing the steel sheet and the carrier blank includes deforming the steel sheet and the carrier blank to form the draw bead geometry using a draw bead channel and a draw bead protrusion.

18. The method of claim 17, further comprising moving the first binder towards the second binder to engage the carrier blank with the first binder and the steel sheet with the second binder.

19. The method of claim 17, the step of compressing the steel sheet and the carrier blank including deforming the steel sheet and the carrier blank to form the draw bead geometry using a draw bead channel and a draw bead protrusion, the draw bead channel engaging the carrier blank, the draw bead protrusion engaging the steel sheet.

* * * * *